United States Patent [19]

Hanyu et al.

[11] 4,423,693

[45] Jan. 3, 1984

[54] FEED DOG STRUCTURE OF SEWING MACHINES

[75] Inventors: Susumu Hanyu, Hachioji; Mikio Koike, Oume; Kazumasa Hara, Hino, all of Japan

[73] Assignee: Janome Sewing Machine Co. Ltd., Tokyo, Japan

[21] Appl. No.: 275,237

[22] Filed: Jun. 19, 1981

[30] Foreign Application Priority Data

Jun. 27, 1980 [JP] Japan ..... 55-89371

[51] Int. Cl.[3] ..... D05B 57/14

[52] U.S. Cl. ..... 112/324; 112/202

[58] Field of Search ..... 112/121.13, 184, 324, 112/202

[56] References Cited

U.S. PATENT DOCUMENTS

| | | | |
|---|---|---|---|
| 2,712,802 | 7/1955 | Cottrell | 112/324 X |
| 3,993,007 | 11/1976 | Ohina et al. | 112/184 |
| 4,182,250 | 1/1980 | Johnson | 112/184 |
| 4,207,826 | 6/1980 | Edwards | 112/184 |

*Primary Examiner*—Werner H. Schroeder
*Assistant Examiner*—Andrew M. Falik
*Attorney, Agent, or Firm*—Michael J. Striker

[57] ABSTRACT

A sewing machine with a vertically reciprocable and laterally swingable needle for sewing provided with an upper thread includes a rotatable loop taker for catching a thread loop during synchronous rotation thereof with the needle, and is rotatable in a horizontal plane with respect to the needle. A bobbin member is mounted within the loop taker and carries a lower thread forforming a lock stitch with the lower thread when the loop taker catches a thread loop. A feed dog member includes a plurality of feed dog elements for synchronously moving vertically and horizontally with the needle so as to allow the fabric to be moved relative to the needle. A thread guide is disposed adjacent a certain one of the plurality of feed dog elements for guiding the lower thread to a predetermined side of the swinging needle each time the feed dog member is vertically moved.

3 Claims, 12 Drawing Figures

FEED DOG STRUCTURE OF SEWING MACHINES

BACKGROUND OF THE INVENTION

1. Field of the Invention

The invention relates to a sewing machine, and more particularly relates to structure of a feed dog member of a sewing machine having a needle vertically reciprocative and laterally swingable and having a loop taker rotated in a horizontal plane around a vertical shaft. The present invention prevents the formation of hitch stitches, as well as the formation of skipped stitches in a sewing machine.

2. Description of the Prior Art

FIGS. 1 to 4 show the conventional positional relations between the needle (2) of sewing machine, which is vertically reciprocated and laterally swingable and the lower or bobbin thread (5) drawn from a bobbin carried by a loop taker rotated in a horizontal plane around a vertical shaft. If a series of straight stitches are produced in this type of sewing machine especially with the needle set to the right side of the basic position, laterally of the swinging region thereof, undesirably deformed hitch stitches (4) are often produced in the normal, perfect stitches (3) as is shown in FIG. 5. For example, when the needle (2) drops on the right side of the lower thread (5) as shown in FIGS. 1 and 2, the normal, perfect stitch is formed. On the other hand, when the needle (2) drops on the left side of the lower thread (5) as shown in FIGS. 3 and 4, the hitch stitch (4) is formed. It is, therefore, necessary to always drop the needle (2) on the right side of the lower thread (5) in order to prevent the formation of the hitch stitches. In other words, the lower thread (5) has to be always located on the left side of the needle (2).

In this type of sewing machine, the loop taker (1) is normally rotated in the direction as indicated by the arrow mark (A) in FIG. 6. It is therefore inevitable that the thread loop (6a) formed at the needle (2) located at the left side of the basic position is larger than that (6*b*) formed at the needle (2) located to the right side of basic position center, laterally of the swinging region thereof. Such a larger thread loop (6*a*) has, as is well known, an inclination to fall toward the machine operation as indicated by the arrow mark (B) in FIG. 7, and to come out of the rotation path of the hook (1*a*) of the loop taker (1). As a result, the hook (1*a*) cannot catch such a deformed thread loop and the stitch is skipped.

SUMMARY OF THE INVENTION

It is an object of the present invention to eliminate the aforesaid defects and disadvantages of the prior art. To the achievement of these objectives, the feed dog member is provided with a guide for normally guiding the lower thread in a direction away from one side of the needle, so as to prevent the formation of hitch stitches. The feed dog member is also provided with an abutment to maintain the thread loop formed at the needle in a normal or suitable condition with respect to the hook of the loop taker, as well as to prevent the formation of skipped stitches.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DETAILED DESCRIPTION OF THE PREFERRED EMBODIMENTS

Figure 1:
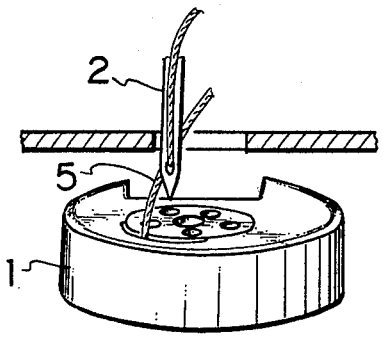
FIG 1 PRIOR ART
FIG. 1 is partly sectional perspective view showing the conventional positional relations between the needle of the sewing machine and lower thread drawn from the bobbin and carried by the loop taker when a normal stitch is formed therewith.
Figure 2:
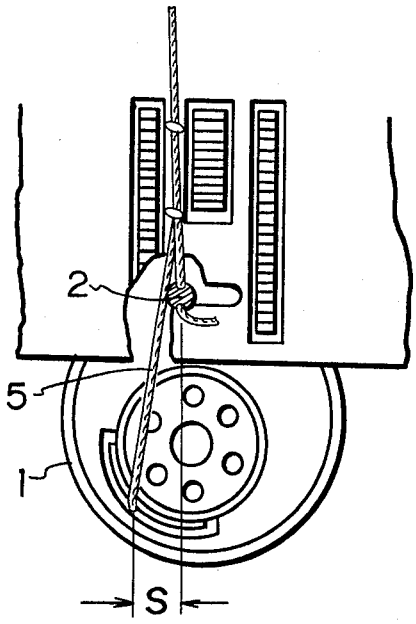
FIG 2 PRIOR ART
FIG. 2 is a plan view of FIG. 1.
Figure 3:
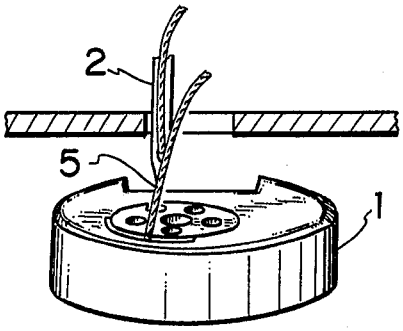
FIG 3 PRIOR ART
FIG. 3 is a partly sectional perspective view showing the conventional positional relations between the needle of the sewing machine and lower thread drawn from the bobbin and carried by the loop taker when a hitch is stitch formed therewith.
Figure 4:
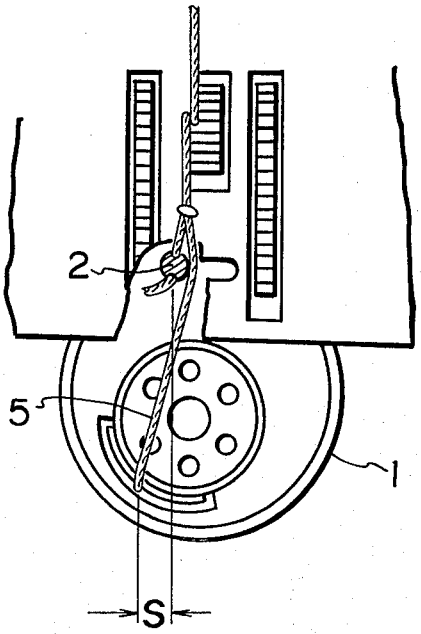
FIG 4 PRIOR ART
FIG. 4 is a plan view of FIG. 3.
Figure 5:
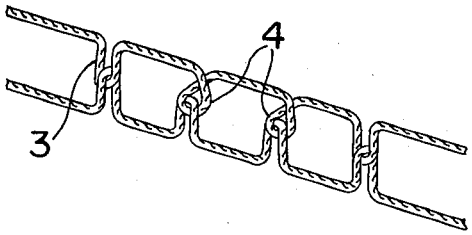
FIG. 5 is a perspective view showing a series of straight stitches including the hitch stitches in the normal perfect stitches.
Figure 6:
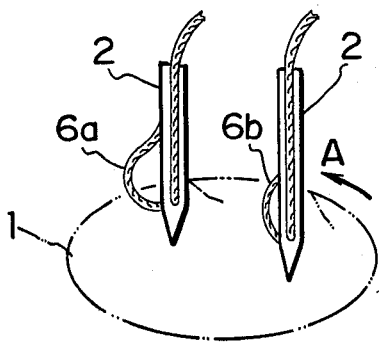
FIGS. 6 and 7 are sectional views showing the formation as well as the condition of a thread loop at the needle in relation to the hook of the loop taker.
Figure 7:
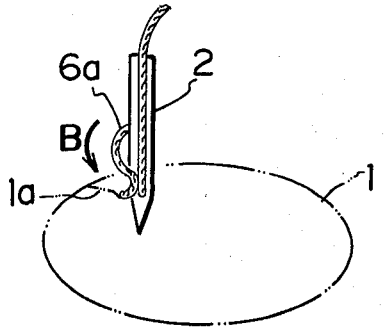

In reference to FIGS. 8 to 11, a loop taker (1) is shown composed of a vertical peripheral wall (11) with a bottom and a vertical center shaft (10) which is arranged substantially in parallel with a needle (2) at a position nearer to the machine then to the operator as is cleary shown. The loop taker (1) is rotated in a horizontal plane in the direction, as indicated by the arrow mark (C), by the vertical center shaft (10) in synchronism with the vertical reciprocating movement of the needle (2). The vertical peripheral wall (11) of the loop taker (1) is partly cut out to form a hook (11*a*) for catching a thread loop formed at the needle during the rotation thereof to produce a stitch.

A bobbin (14) loaded with a lower thread (5) is carried by a bobbin carrier (13), which is supported in the vertical peripheral wall (11) of the loop taker (1). The bobbin carrier is prevented from rotation as well as from axial movement thereof by a pair of rockable arms in a well known manner. A tension spring (15) is secured to the bobbin carrier (13). The tension spring (15) is formed with a cutout (15*a*) at a suitable position thereof at which the lower thread (5) is drawn out from the bobbin (14) with a predetermined amount of tension applied thereto.

A feed dog structure (16) is mounted on a support (17) under a needle plate (25) having a needle dropping hole (25*a*). The feed dog structure (16) is vertically and horizontally moved to transport a fabric (34) to be stitched. The feed dog member substantially comprises a base plate (16*a*) which is secured to the support (17) by a pair of screws (18) and three elongated feed dog elements (19, 20, 21) which feed dog elements are formed integrally with the base plate (16*a*) and arranged in parallel to each other. These feed dog elements (19, 20, 21) are each provided with serrated teeth at the top thereof for effecting the transport of the fabric (34).

Figure 8:
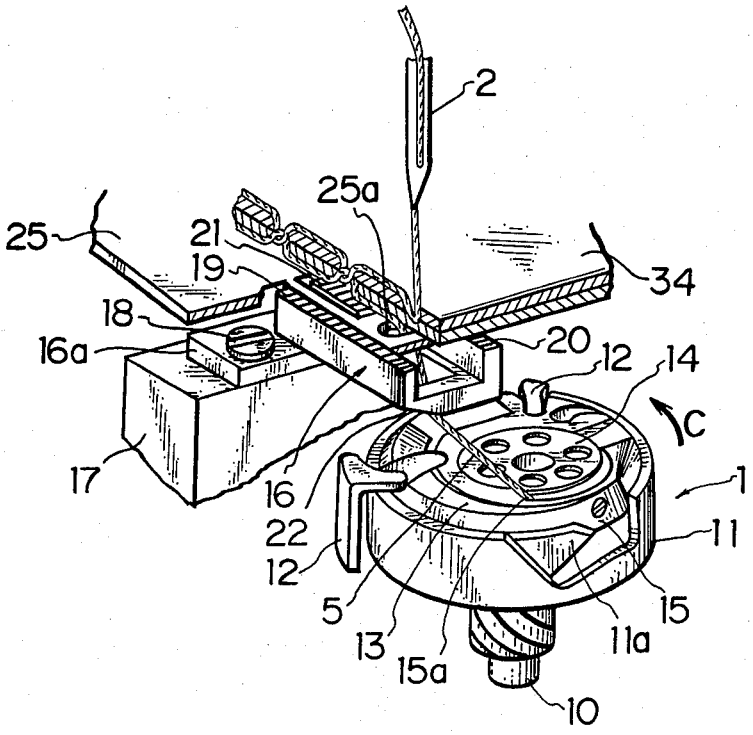
FIG. 8 is a perspective view showing the formation of straight stitches in accordance with a preferred embodiment of the present invention.
Figure 9:
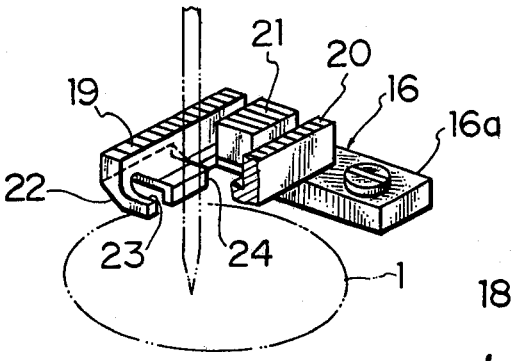
FIG. 9 is a perspective view of a feed dog member according to the invention.

As is best shown in FIG. 8, an inclined face (22) is provided at a position adjacent to the front end of the feed dog element (19). The inclined face (22) is extended transversely of the bottom of the feed dog element (19) halfway toward the opposite feed dog element (20), and is progressively lowered toward the opposite feed dog element (20). The feed dog element (19) has a lateral projection (24) with a bent-down end providing an abutment formed on one side thereof and extended toward the vertical reciprocating path of the needle (2). The abutment (24) and the inclined extension (22) define a transverse recess (23) therebetween.

Figure 12:
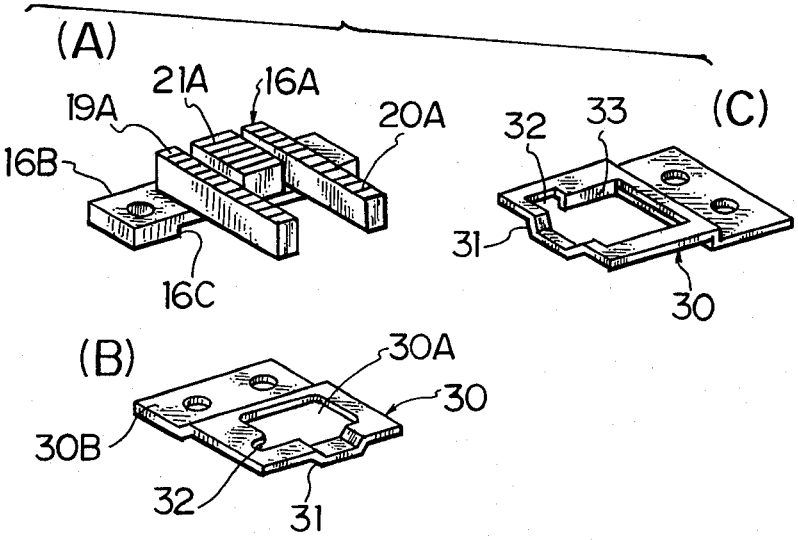
FIG. 12 is a perspective view of another preferred embodiment of the invention.

FIG. 12 shows another embodiment of the invention, in which a frame (30) with an opening (30A) is employed together with a feed dog member (16A). The feed dog member (16A) comprises three elongated feed dogs (19A, 21A, 20A) and a base plate (16B) which are integrally formed therewith as is clearly shown. The base plate (16B) is provided with a cutout (16C) in which the mounting part (30B) of the frame (30) is to be inserted, so that the feed dog member (16A) may be secured, together with the frame (30), to a support such as the one (17) as shown in FIG. 8. Thus, the frame (30) is positioned under the feed dog member (16A) on the support (17). The frame (30) is formed at the front thereof with an inclined face (31) which laterally extends from the left side of feed dog element (19A) to the opposite right side of feed dog element (20A) and is progressively lowered toward the latter. The frame (30) is also formed with an abutment (33) on one side thereof which is extended halfway into the opening (30A) from the feed dog element (19A) toward the vertical reciprocating path of the needle (2). The abutment (33) and the inclined extension define a recess (32) therebetween as shown.

Figure 11:
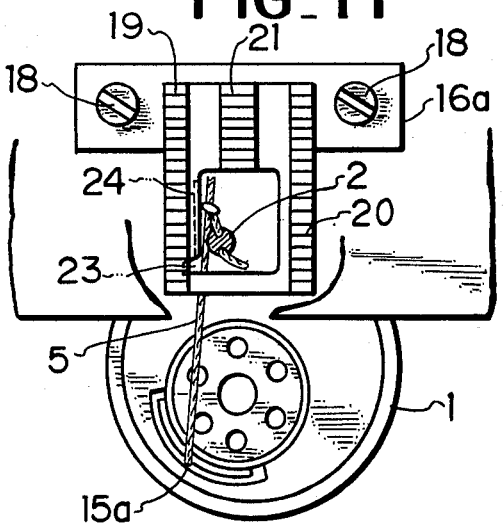
FIG. 11 is a plan view of the feed dog structure of FIG. 10 showing a positional relation between the needle and the lower thread in the formation of straight stitches.
Figure 10:
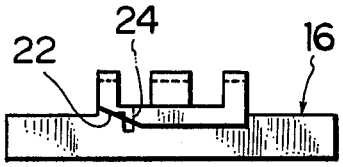
FIG. 10 is a front elevational view of the feed dog structure in accordance with invention.

Operation of the invention is as follows. If the sewing machine is operated to produce a series of straight stitches with the needle (2) being set to the left side of the basic position, the needle (2) with the upper thread is vertically reciprocated and the feed dog member (16, 16A) is vertically and horizontally reciprocated to transport the fabric (34) relative to the needle (2), and straight stitches are formed as shown in FIG. 8. The lower thread (5) is drawn out from the bobbin (13) at the cutout (15*a*) of the tension spring (15) and is extended to the fabric to be sewn, as is shown in FIGS. 8 and 11. Each time the feed dog member (16, 16A) is downwardly moved, the inclined face (22, 31) of the feed dog member (16, 16A) depresses the lower thread (5) and guides the latter into the recess (23, 32). Thus, the lower thread (5) is moved in the direction away from the vertical reciprocating path of the needle (2) on the left side thereof each time the feed dog member (16, 16A) is downwardly moved. From the aforesaid, it will be apparent that the needle (2) is always reciprocated vertically on the right side of the lower thread (5), and is prevented from dropping on the left side of the latter. Thus, the formation of hitch stitches is prevented. Additionally, the thread loop (6*a*) formed at the needle (2) is supported in a suitable condition by the abutment (24, 33) of the feed dog member (16, 16A) and is prevented from falling toward the machine operator. Thus, the formatio of skipped stitches is prevented.

While the invention has been illustrated and described as embodied in a feed dog structure of sewing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sewing machine having a vertically reciprocative and laterally swingable needle for sewing, said needle carrying a first thread, said machine comprising:

(a) a rotatable loop taker, said loop taker being adapted to catch a thread loop during a sychronous rotation thereof with the vertical reciprocating movement of said needle, said loop taker being rotatable in a horizontal plane with respect to said needle;

(b) a bobbin member mounted within said loop taker and carrying a second thread; said second thread being adapted to form a lock stitch with said first thread when said loop taker catches a thread loop of said first thread;

(c) a feed dog member, said feed dog member including a plurality of feed dog elements, said feed dog elements being vertically and horizontally movable synchronously with said swingable needle so as to allow the fabric to be moved relative to said needle; and (d) a thread guide positioned on a certain one of said plurality of feed dog elements, said thread guide being adapted to guide said second thread away from a vertical reciprocating path of said swingable needle to the left side thereof if viewed from the position of the machine operator each time said feed dog elements are vertically moved.

2. A sewing machine having a vertically reciprocative and laterally swingable needle for sewing, said needle carrying a first thread, said machine comprising:

(a) a rotatable loop taker, said loop taker being adapted to catch a thread loop during synchronous rotation thereof with the vertical reciprocating movement of said needle, said loop taker being rotatable in a horizontal plane with respect to said needle;

(b) a bobbin member mounted within said loop taker and carrying a second thread, said second thread being adapted to form a lock stitch with said first thread when said loop taker catches a thread loop of said first thread;

(c) a feed dog member, said feed dog member including a plurality of feed dog elements, said feed dog elements being vertically and horizontally movable synchronously with said swingable needle so as to allow the fabric to be moved relative to said needle; and (d) a thread guide disposed adjacent a certain one of said plurality of feed dog elements and adapted to guide said second thread away from the vertically reciprocating path of said needle, and wherein one of said feed dog elements being provided with an abutment for supporting said thread loop during formation thereof, such that said thread loop is caught by said loop taker.

3. A sewing machine having a vertically reciprocative and laterally swingable needle for sewing, said needle carrying a first thread, said machine comprising:

(a) a rotatable loop taker, said loop taker being adapted to catch a thread loop during sychronous rotation thereof with the vertical reciprocating movement of said needle, said loop taker being rotatable, in a horizontal plane with respect to said needle;

(b) a bobbin member mounted within said loop taker and carrying a second thread, said bobbin member being adapted to form a lock stitch with said first thread when said loop taker catches a thread loop of said first thread;

(c) a feed dog member, said feed dog member, including a plurality of feed dog elements, said feed dog elements being vertically and horizontally movable synchronously with said swingable needle so as to allow the fabric to be moved relative to said needle; and (d) a thread guide disposed adjacent a certain one of said plurality of feed dog elements, said thread guide being adapted to guide the second thread away from a vertical reciprocating path of the needle and to a predetermined side thereof each time said feed dog elements are vertically moved, and wherein one of said feed dog elements is provided with an abutment for supporting said thread loop during a forming thereof, such that said loop may be caught by said loop taker, said thread guide and said abutment defining a recess therebetween for said guiding said second thread away from said path of said needle.

* * * * *